US007331084B2

(12) United States Patent
Oh

(10) Patent No.: US 7,331,084 B2
(45) Date of Patent: Feb. 19, 2008

(54) DUST COLLECTING APPARATUS FOR CYCLONE TYPE VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 687 days.

(21) Appl. No.: 10/656,127

(22) Filed: Sep. 8, 2003

(65) Prior Publication Data

US 2004/0163207 A1 Aug. 26, 2004

(30) Foreign Application Priority Data

Feb. 26, 2003 (KR) ..... 10-2003-0012029

(51) Int. Cl.
*A47L 9/16* (2006.01)

(52) U.S. Cl. ..... 15/353; 15/352; 55/337; 55/429; 55/459.1; 55/DIG. 3

(58) Field of Classification Search ..... None
See application file for complete search history.

(56) References Cited

U.S. PATENT DOCUMENTS

| | | | | |
|---|---|---|---|---|
| 4,706,327 | A | 11/1987 | Getz et al. | |
| 5,148,569 | A | 9/1992 | Jailor et al. | |
| 5,254,147 | A | 10/1993 | Finke | |
| 5,779,745 | A * | 7/1998 | Kilstrom | 55/337 |
| 6,042,628 | A * | 3/2000 | Nishikiori et al. | 55/337 |
| 6,269,518 | B1 | 8/2001 | Yung | |
| 6,436,160 | B1 * | 8/2002 | Stephens et al. | 55/337 |
| 6,519,804 | B1 | 2/2003 | Vujik | |
| 6,648,934 | B2 | 11/2003 | Choi et al. | |
| 6,757,933 | B2 * | 7/2004 | Oh et al. | 15/353 |
| 6,810,557 | B2 | 11/2004 | Hansen et al. | |

(Continued)

FOREIGN PATENT DOCUMENTS

EP 1195125 4/2002

(Continued)

OTHER PUBLICATIONS

Combined Search and Examination Report issued Mar. 12, 2004 from the British Patent Office with respect to British Patent Application No. 0323097.6 filed Oct. 2, 2003.

(Continued)

*Primary Examiner*—David Redding
(74) *Attorney, Agent, or Firm*—Blank Rome LLP

(57) ABSTRACT

A dust collecting apparatus for a vacuum cleaner, which includes, a cyclonic chamber with an air inlet and a first outlet being formed therein, the cyclonic chamber causing air from the air inlet to spin therein, a dust receptacle connected to the cyclonic chamber, a grill assembly in the cyclonic chamber and on the upstream side of the air outlet to prevent dust and contaminants separated from the air from backflowing through the first air outlet, a main filter assembly connected to the grill assembly for filtering out dust and contaminants from the air backflowing from the grill assembly, and a supplementary filter assembly on the outside of the cyclonic chamber to re-filter the fine dust and contaminants incoming from the first air outlet. While conventional cyclone type vacuum cleaners are limited by the amount of contaminants that can be separated from the air, the disclosed vacuum cleaner can more effectively separate dust and contaminants.

25 Claims, 7 Drawing Sheets

U.S. PATENT DOCUMENTS

| | | | | |
|---|---|---|---|---|
| 2003/0019073 | A1 | 1/2003 | Oh | |
| 2003/0066273 | A1 | 4/2003 | Choi et al. | |
| 2004/0200028 | A1* | 10/2004 | Oh et al. | 15/347 |

FOREIGN PATENT DOCUMENTS

| | | | |
|---|---|---|---|
| EP | 0 803 224 | B1 | 12/2002 |
| GB | 2368005 | A | 4/2002 |
| GB | 2377656 | A | 1/2003 |
| GB | 2389034 | A | 12/2003 |
| WO | WO 01/41617 | A1 | 6/2001 |
| WO | WO 02/078505 | | 10/2002 |
| WO | WO 02/078506 | | 10/2002 |

OTHER PUBLICATIONS

Examiner's First Report (issued Aug. 12, 2004) issued from the Australian Patent Office for Australian Patent Application No. 2003248386, filed Sep. 24, 2003.

Canadian Patent Office, Official Action issued Aug. 17, 2005 with respect to corresponding Canadian Patent Application No. 2,447,976 filed on Nov. 3, 2003.

* cited by examiner

DUST COLLECTING APPARATUS FOR CYCLONE TYPE VACUUM CLEANER

BACKGROUND OF THE INVENTION

1. Field of the Invention

The present invention relates to a cyclone type vacuum cleaner, and more particularly, to dust collecting apparatus for a cyclone type vacuum cleaner capable of preventing dust and contaminants which are drawn into a cyclonic chamber, from leaking towards a current driving source.

2. Description of the Prior Art

Generally, a dust collecting apparatus for a cyclone type vacuum cleaner generates spinning air in a cyclonic chamber and separates dust and contaminants from the air by using centrifugal force generated from the spinning air. The dust collecting apparatus is usually provided with a dust backflow preventing portion for preventing backflow of dust and contaminants towards the air outlet of the cyclonic chamber. One example of a conventional dust collecting apparatus for a cyclone type vacuum cleaner having such a dust backflow preventing portion is disclosed in WO 00164321.

FIGS. 1 and 2A and 2B illustrate one example of a conventional cyclone type vacuum cleaner having a dust backflow preventing portion. As shown, the dust collecting apparatus 10 for cyclone type vacuum cleaner includes a cyclonic chamber 11, a dust receptacle 13 and a grill assembly 20.

The cyclonic chamber 11 includes an air inlet 11*a* and an air outlet 11*b*. The air inlet 11*a* is formed in a side of the cyclonic chamber 11 in a tangential direction. The air outlet 11*b* is formed approximately at the center of the upper side of the cyclonic chamber 11. With the cyclone dust collecting apparatus 10 being mounted on the cleaner body, the air inlet 11*a* is connected with a first conduit 31 which is fluidly connected to a suction brush (not shown) of the cleaner body, while the air outlet 11*b* is connected with a second conduit 33 which is fluidly connected to a motor driving chamber (not shown) of the cleaner body.

Accordingly, dust and contaminant laden air, which is drawn in through the suction brush, is passed through the first conduit 31 and the air inlet 11*a* and drawn into the cyclonic chamber 11 in a tangential direction. As a result, the drawn air is spinning in the cyclonic chamber 11, and the dust is thrown out from the air by the centrifugal force of the spinning air. The cleaned air is discharged outside via the air outlet 11*b*, the second conduit 33 of the cleaner body and the motor driving chamber.

The dust receptacle 13 is removably connected to the lower portion of the cyclonic chamber 11, and collects the dust thrown out from the spinning air of the cyclonic chamber 11.

A grill assembly 20 is mounted at the gate of the air outlet 11*b* inside the cyclonic chamber 11, preventing the separated dust and contaminants from flowing back through the air outlet 11*b*. The grill assembly 20 has a plurality of louvers 23 formed on the outer circumference of the grill body 21 which are in fluid contact with the air outlet 11*b*.

The louvers 23 are connected and arranged on the outer circumference of the grill body 21 at predetermined intervals. As shown in FIG. 2A, there are air passages 23*a* defined between the louvers 23.

As shown in FIG. 2B, each louver 23 is arranged such that the centerline thereof is at an acute angle with respect to the streamline of the spinning air (shown as an arrow). Accordingly, there is an abrupt direction shift of the air particles more than 90° when the air enters the air passages 23*a* among the louvers 23, and thus, air velocity changes and dust is separated from the air.

As described above, by forming the grill assembly with the plurality of louvers 23 formed thereon at the air outlet side, some dust particles can be separated from the air. However, there are other dust and contaminant particles that remain in the air current even with the air velocity changes. These remaining dust and contaminant particles are directed toward the air driving source, deteriorating the performance of the cyclone type vacuum cleaner.

SUMMARY OF THE INVENTION

Accordingly, it is an aspect of the present invention to provide a dust collecting apparatus for a cyclone type vacuum cleaner, that overcomes the inability of the prior art dust backflow preventing devices such as a grill assembly to more effectively separate dust and contaminants from the air, by filtering the air passing through the dust backflow preventing portion of the apparatus.

In order to achieve the above aspects and/or features of the present invention, a dust collecting apparatus for a cyclone type vacuum cleaner includes a cyclonic chamber having an air inlet in fluid contact with a first conduit which is in fluid contact with a suction brush of a cleaner body, and also having a first air outlet, the cyclonic chamber causing a dust and contaminant-laden air stream drawn through the air inlet to spin, a dust receptacle for receiving dust and contaminants which are thrown out from the spinning air by a centrifugal force, the dust receptacle removably connected to the cyclonic chamber, a grill assembly disposed inside the cyclonic chamber and on an upstream side of the air outlet for preventing the dust and contaminants, which are thrown out of the drawn air, from flowing backwards through the first air outlet, and a filter assembly formed at an outer side of the cyclonic chamber for filtering out the dust and contaminants being discharged from the air outlet. The filter assembly includes a filter member, a filter frame receiving the filter member therein, and having a second air outlet corresponding to the first air outlet of the cyclonic chamber, and a third air outlet in fluid contact with a second conduit which is in fluid contact with an air driving source, and a cover portion removably connected with the filter frame in which the filter member is seated.

There are provided a plurality of first support projections formed along an inner surface of a lower portion of the filter frame, for causing the incoming air from the second air outlet to be evenly distributed over the filter member surface.

There are provided a plurality of second support projections formed along an inner surface of an upper portion of the cover portion, for causing the air passing through the filter member to flow through the third air outlet and also for supporting the filter member in cooperation with the first support projections.

According to a preferred embodiment of the present invention, free ends of the first and the second support projections are rounded, and the cover portion is connected with the filter frame by a rotatable connecting means.

The rotatable connecting means includes at least one connecting groove portion formed on the upper side of the filter frame and facing each other, having one side that is open in the rotation direction of the cover portion and another side that is closed, and at least one connecting projection formed on the cover portion in a radial direction to correspond to the connecting groove portion.

The cover portion includes a grip formed on the outer side of the upper portion, for easy handling of the cover portion when rotating the cover portion for connecting with the filter frame.

Furthermore, the filter frame can be removably screw-fastened with the upper side of the cyclonic chamber, and the filter frame can be integrally formed with the upper side of the cyclonic chamber.

Meanwhile, the grill assembly includes a grill body, a plurality of louvers formed on the outer circumference of the grill body at an acute angle with respect to the streamline of the spinning air, and a dust blocking member formed at an upstream end of the grill body, for shifting the advancing direction of the contaminant in the louver-headed air toward the spinning air.

The upper side of the grill body may include a screw hole for screw-fastening the grill body to the cyclonic chamber.

The lower side of the filter frame may include a screw hole corresponding to the screw hole of the upper side of the grill body. Accordingly, the grill body, the cyclonic chamber and the filter frame can be screw-fastened to each other.

The dust blocking member may be integrally formed with the grill body.

The dust blocking member includes a first conical member secured to the grill body and increasing in diameter towards the lower portion, and a second cylindrical member directly extended downwardly from the first conical member to a predetermined depth.

The first conical member and the second cylindrical member may be integrally formed with each other.

Furthermore, in order to achieve the above aspects and/or features of the present invention, a dust collecting apparatus for a cyclone type vacuum cleaner includes a cyclonic chamber having an air inlet in fluid contact with a first conduit which is in fluid contact with a suction brush of a cleaner body, and also having a first air outlet, the cyclonic chamber causing a dust and contaminant-laden air stream drawn through the air inlet to spin, a dust receptacle for receiving dust and contaminants which are thrown out from the spinning air by a centrifugal force, the dust receptacle removably connected to the cyclonic chamber, a grill assembly disposed inside the cyclonic chamber and on an upstream side of the air outlet for preventing the dust and contaminants, which are thrown out of the drawn air, from flowing backwards through the first air outlet, a main filter assembly removably connected inside the grill assembly, for filtering out the dust and contaminants being discharged from the grill assembly, and a supplementary filter assembly formed at an outside of the cyclonic chamber, for re-filtering minute dust and contaminants flowing in through the first air outlet.

The main filter assembly includes a main filter member for filtering dust and contaminants back-flowing from the grill assembly, a main filter support portion having a plurality of frames for supporting the main filter member from within, and a dust blocking member disposed at a lower end of the main filter support portion, for shifting the advancing direction of the contaminant in the grill assembly-headed air towards the spinning air.

The main filter member may be formed of a washable material for easy cleaning, and provided on the main filter member may be folds for increasing the contact area with the incoming air through the grill assembly.

According to the preferred embodiment of the present invention, the folds of the main filter member are formed in a lengthwise direction of the main filter member.

The main filter member may be formed of polyester.

The dust blocking member includes a first conical member secured to the main filter member and increasing in diameter towards the lower portion, and a second cylindrical member directly extended downwardly from the first conical member to a predetermined depth.

The first conical member and the second cylindrical member may be integrally formed with each other.

Here, the grill assembly includes a grill body, with upper side being removably connected to the upper side of the cyclonic chamber and the lower side being sealingly supported on the dust blocking member, and a plurality of louvers formed on the outer circumference of the grill body to form an acute angle with respect to the streamline of the spinning air.

The upper side of the grill body may include a screw hole for screw-fastening the grill body to the cyclonic chamber.

The supplementary filter assembly includes a supplementary filter member, a supplementary filter frame receiving the supplementary filter member therein, with a second air outlet being formed therein corresponding to the first air outlet of the cyclonic chamber, and a third air outlet being formed in a side thereof in fluid contact with a second conduit which is in fluid contact with an air driving source, and a cover portion removably connected with the upper side of the supplementary filter frame in which the supplementary filter member is seated.

There are provided a plurality of first support projections formed along the inner surface of the lower portion of the filter frame, for causing the incoming air through the second air outlet to be evenly distributed over the filter member surface.

There are provided a plurality of second support projections formed along the inner surface of the upper portion of the cover portion, for causing the air passing through the supplementary filter member to flow through the third air outlet and also for supporting the supplementary filter member in cooperation with the first support projections.

The cover portion is connected to the supplementary filter frame by a rotatable connecting means.

The rotatable connecting means includes at least one connecting groove portion formed on the upper side of the filter frame and facing each other, having one side that is open in the rotation direction of the cover portion and another side that is closed, and at least one connecting projection formed on the cover portion in a radial direction to correspond to the connecting groove portion.

On the outer side of the upper portion of the cover is a grip for easy handling of the cover portion when rotating the cover portion for connecting with the filter frame.

The supplementary filter frame can be removably screw-fastened with the upper side of the cyclonic chamber, and the supplementary filter frame can be integrally formed with the upper side of the cyclonic chamber.

The upper side of the grill body may include a screw hole for screw-fastening the grill body to the cyclonic chamber, the upper side of the main filter support portion may include a screw hole corresponding to the screw hole of the grill body, and the lower side of the supplementary filter frame may include a screw hole corresponding to the screw hole of the upper side of the grill body. Accordingly, the grill body, the main filter support portion, the cyclonic chamber and the supplementary filter frame may be screw-fastened to each other.

The grill assembly includes a grill body, a plurality of louvers formed on the outer circumference of the grill body at an acute angle with respect to the streamline of the spinning air, and a dust blocking member formed at an upstream end of the grill body, for shifting the advancing direction of the contaminant in the louver-headed air toward the spinning air.

The main filter assembly includes a main filter member for filtering the backflow of dust and contaminants of the grill assembly, and a main filter support portion having a plurality of frames for supporting the main filter member from within, and sealingly supported on the dust blocking member of the grill assembly.

The grill assembly and the main filter assembly are integrally formed with each other, and in the upper side of the grill body may be formed a screw hole for a screw-fastening with the cyclonic chamber.

The upper side of the grill body may include a screw hole for screw-fastening the grill body to the cyclonic chamber, and the lower side of the supplementary filter frame may include a screw hole corresponding to the screw hole of the upper side of tie grill body. Accordingly, the grill body being integrally formed with the main filter assembly, the cyclonic chamber and the supplementary filter frame may be screw-fastened with each other, integrally.

The dust blocking member includes a first conical member secured to the grill body and increasing in diameter towards the lower portion, and a second cylindrical member directly extended downward from the first conical member to a predetermined depth.

While the conventional cyclone type vacuum cleaner is limited in the amount of dust and contaminants that it can separate from the drawn air using dust backflow preventing device such as louvers, the cyclone type vacuum cleaner according to the present invention, provided with the main filter assembly and the supplementary filter assembly, can better separate dust and contaminants.

As a result, deterioration of dust collecting efficiency due to backflow of contaminant is prevented, and a cyclone type vacuum cleaner that satisfies the customer's demands and has a higher competitiveness can be provided.

With these and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

The above aspects and other features of the present invention will become more apparent by describing in detail a preferred embodiment thereof with reference to the attached drawings, in which.

DETAILED DESCRIPTION OF THE PREFERRED EMBODIMENT

Figure 1:
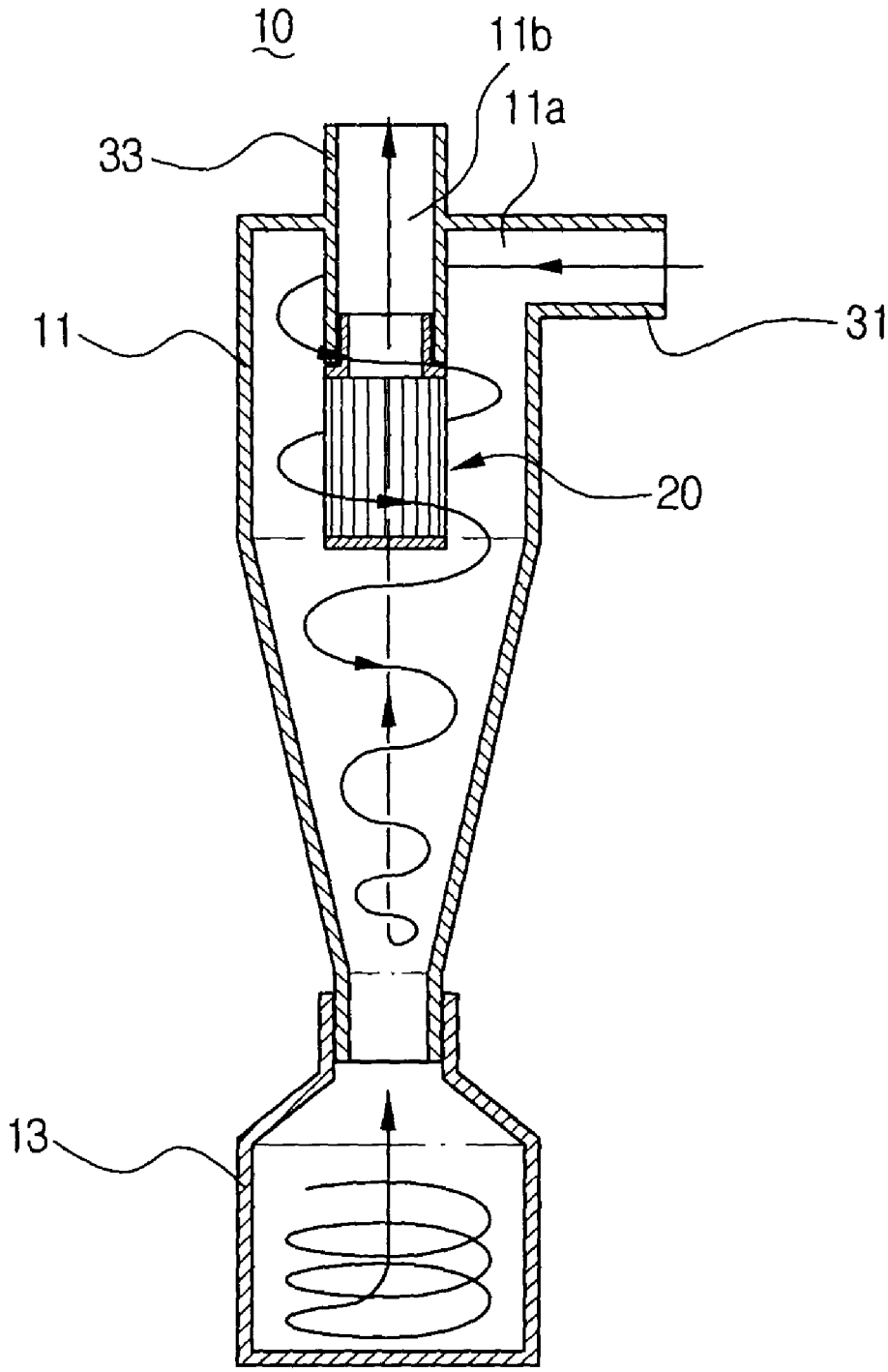
FIG. 1 (PRIOR ART)
FIG. 1 is a cross-sectional view schematically showing a conventional dust collecting apparatus for a cyclone type vacuum cleaner.

Hereinafter, the present invention will be described in detail with reference to the accompanying drawings. Several preferred embodiments of the invention are described for illustrative purposes, it being understood that the invention may be embodied in other forms not specifically shown in the drawings.

Figure 3:
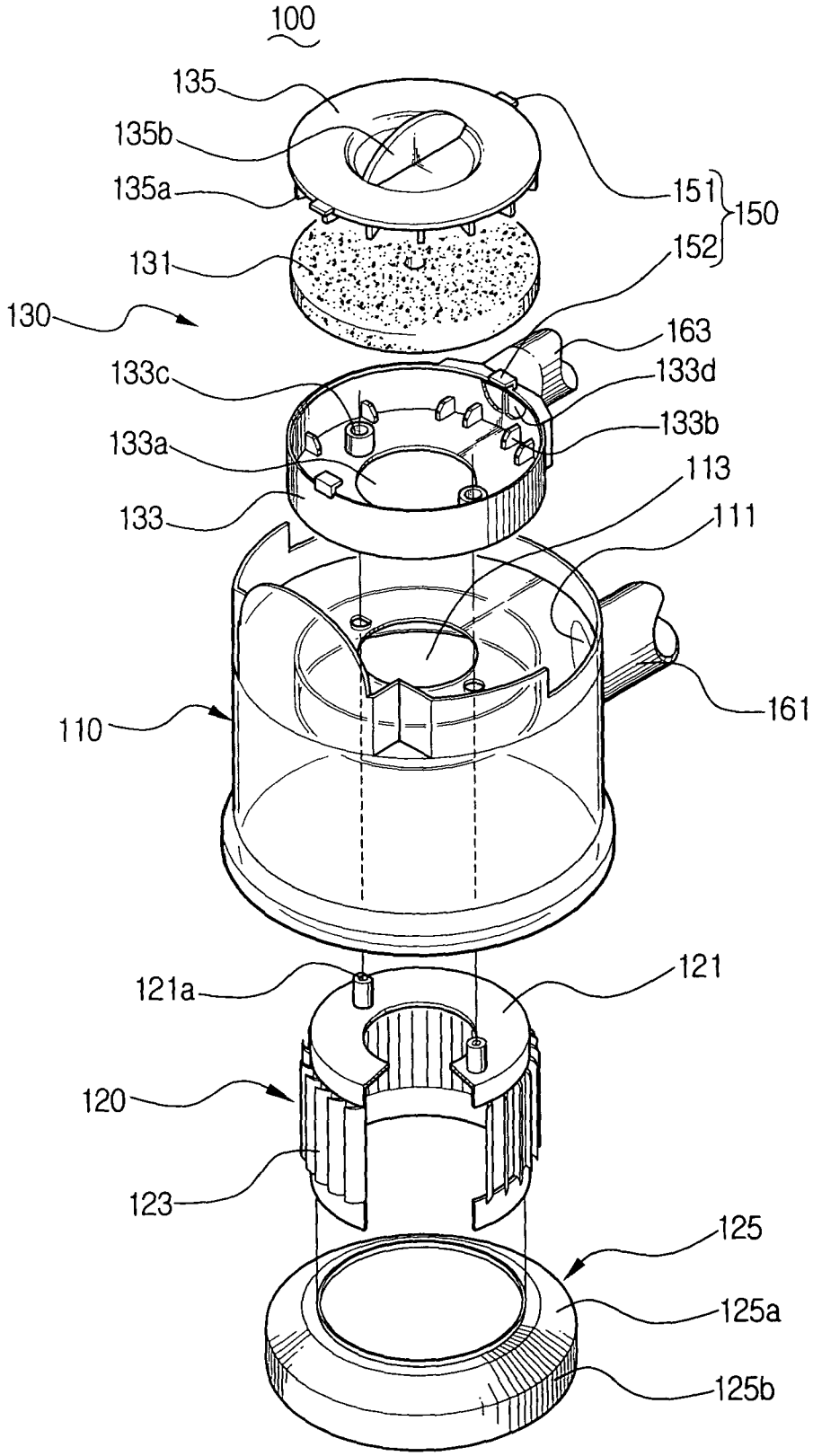
FIG. 3 is an exploded perspective view schematically illustrating a dust collecting apparatus for a cyclone type vacuum cleaner according to a first preferred embodiment of the present invention.
Figure 4:
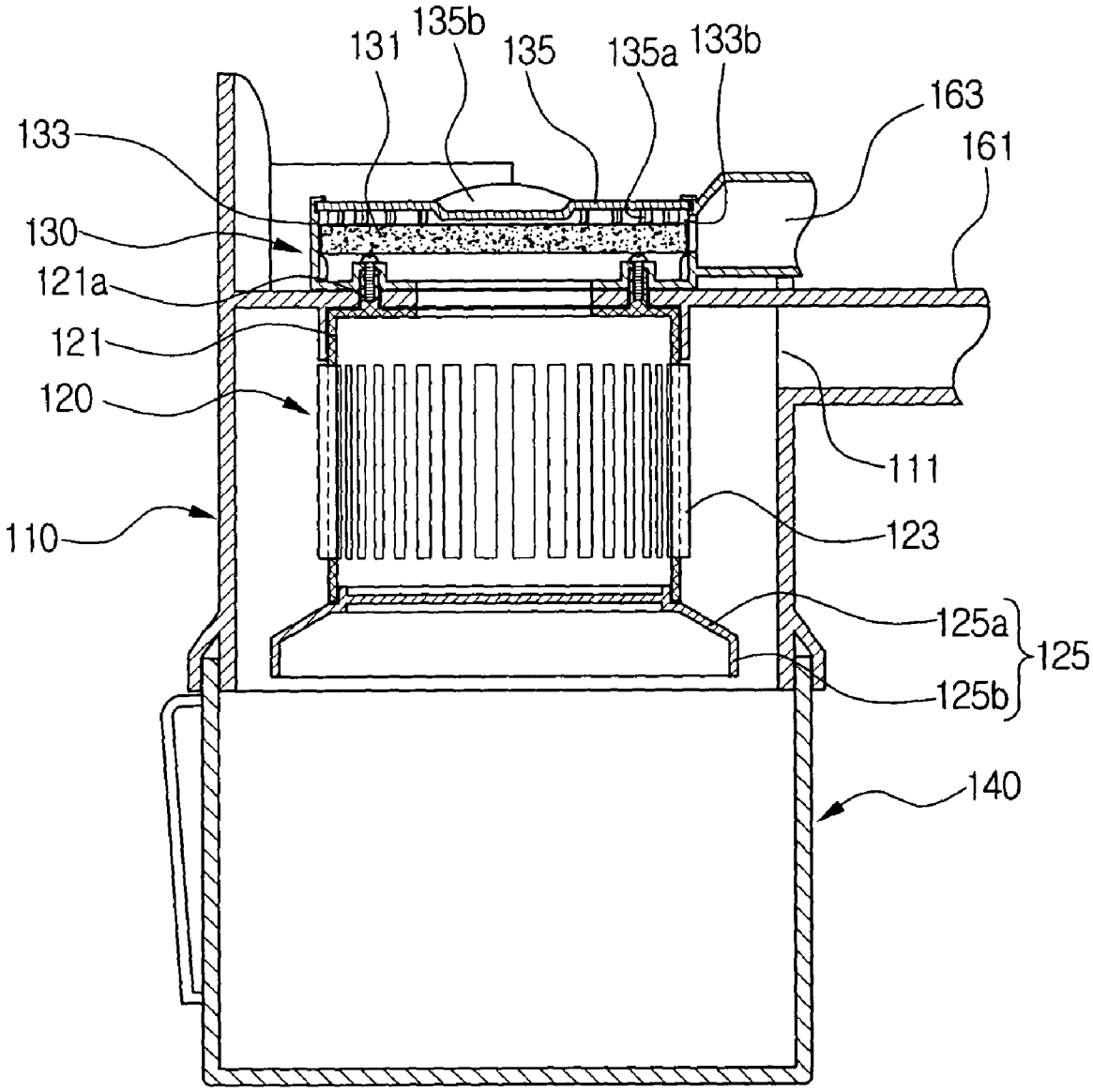
FIG. 4 is a schematic cross-sectional view illustrating the dust collecting apparatus of FIG. 3.

FIG. 3 is an exploded perspective view of a dust collecting apparatus for a cyclone type vacuum cleaner according to a first preferred embodiment of the present invention, and FIG. 4 is a cross-sectional view of the dust collecting apparatus of FIG. 3.

The reference numeral 100 denotes a cyclone dust collecting apparatus, 110 is a cyclonic chamber, 120 is a grill assembly, 130 is a filter assembly, 140 is a dust receptacle, and 150 is a rotatable connecting means.

According to the first preferred embodiment of the present invention, the dust collecting apparatus 100 for a cyclone type vacuum cleaner includes the cyclonic chamber 110, the dust receptacle 140, the grill assembly 120 and the filter assembly 130.

The cyclonic chamber 110 includes an air inlet 111 through which air generated by an air driving source (not shown) is drawn, and a first air outlet 113 through which the air is discharged. The cyclonic chamber 110 is open at a lower side. The air inlet 111 is connected to a first conduit 161 which is in fluid contact with a suction brush (not shown) of a cleaner body (not shown), and formed in a tangential direction with respect to the side of the cyclonic chamber 110. Accordingly, the air spins as it is drawn into the cyclonic chamber 110. The first air outlet 113 is connected to a second conduit 163 which is in fluid contact with the air driving source (not shown) of the cleaner body, and formed approximately at a center of the upper side of the cyclonic chamber 110.

The dust-laden air is drawn in through the suction brush (not shown) during the cleaning operation, and then drawn via the air inlet 111 into the cyclonic chamber 110 in a tangential direction. As a result, the air spins in the cyclonic chamber 110, and the dust is thrown out by the centrifugal force of the spinning air current. The cleaned air is discharged via the air outlet 111 and the air driving source (not shown).

The dust receptacle 140 is removably connected to the lower portion of the cyclonic chamber 110 to receive dust and contaminant thrown out from the spinning air of the cyclonic chamber 110. The dust receptacle 140 may be provided with a handle for a user to grip, and when the dust receptacle 140 is filled with the dust, the dust receptacle 140 is separated from the cleaner and collected dust is dumped.

The grill assembly 120 is formed at the first air outlet 113 inside of the cyclonic chamber 110, and prevents the separated dust and contaminant from flowing backward through the first air outlet 113. The grill assembly 120 includes a grill body 121, louvers 123 formed on the outer circumference of the grill body 121 and a dust blocking member 125 formed at an upstream end of the grill body 121.

The grill body 121 has a screw hole 121*a* formed at the upper side, for screw-fastening to the cyclonic chamber 110.

Figure 2A:
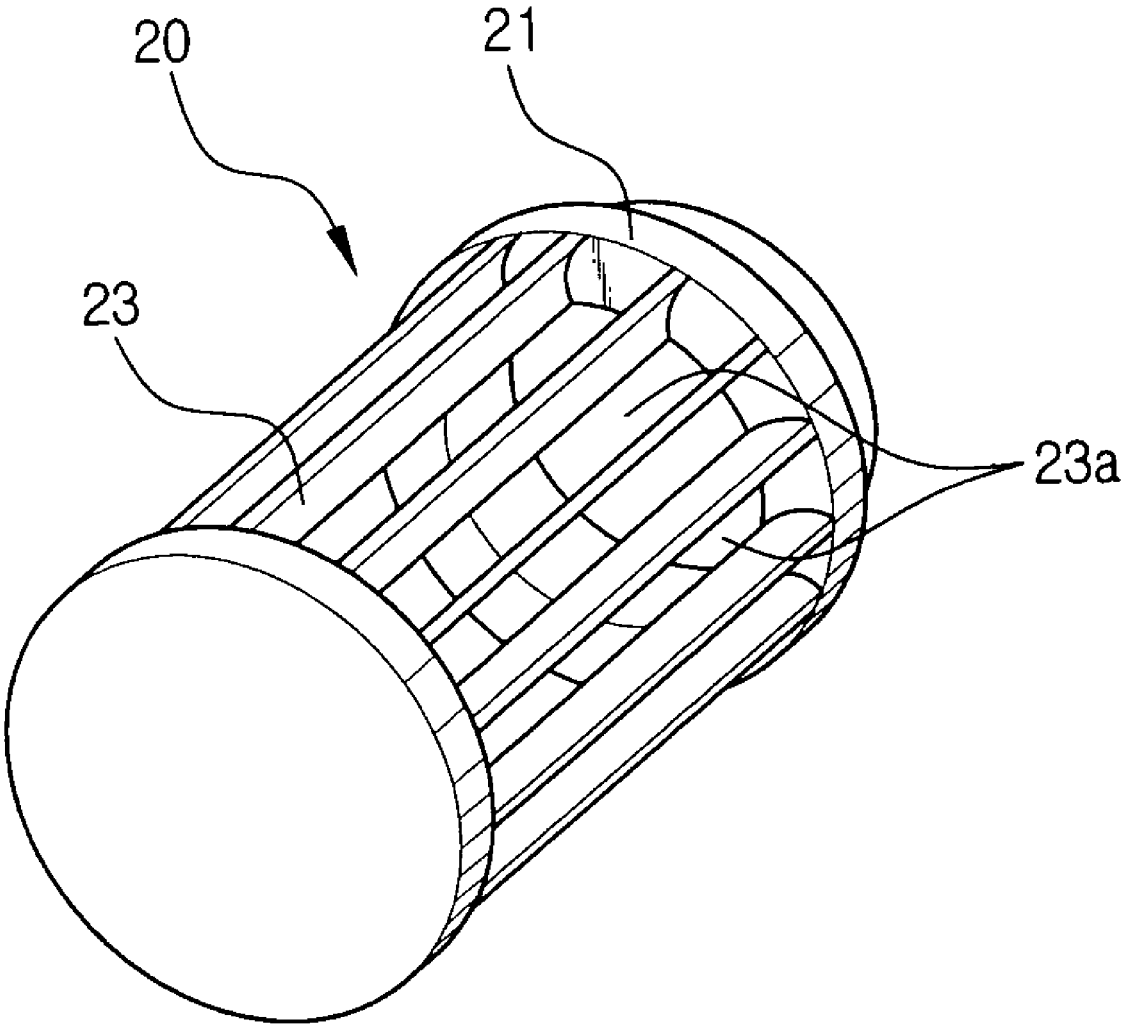
FIG. 2A (PRIOR ART)
FIG. 2A is a schematic perspective view of a grill assembly adapted to the dust collecting apparatus of FIG. 1 showing an arrangement of louvers.
Figure 2B:
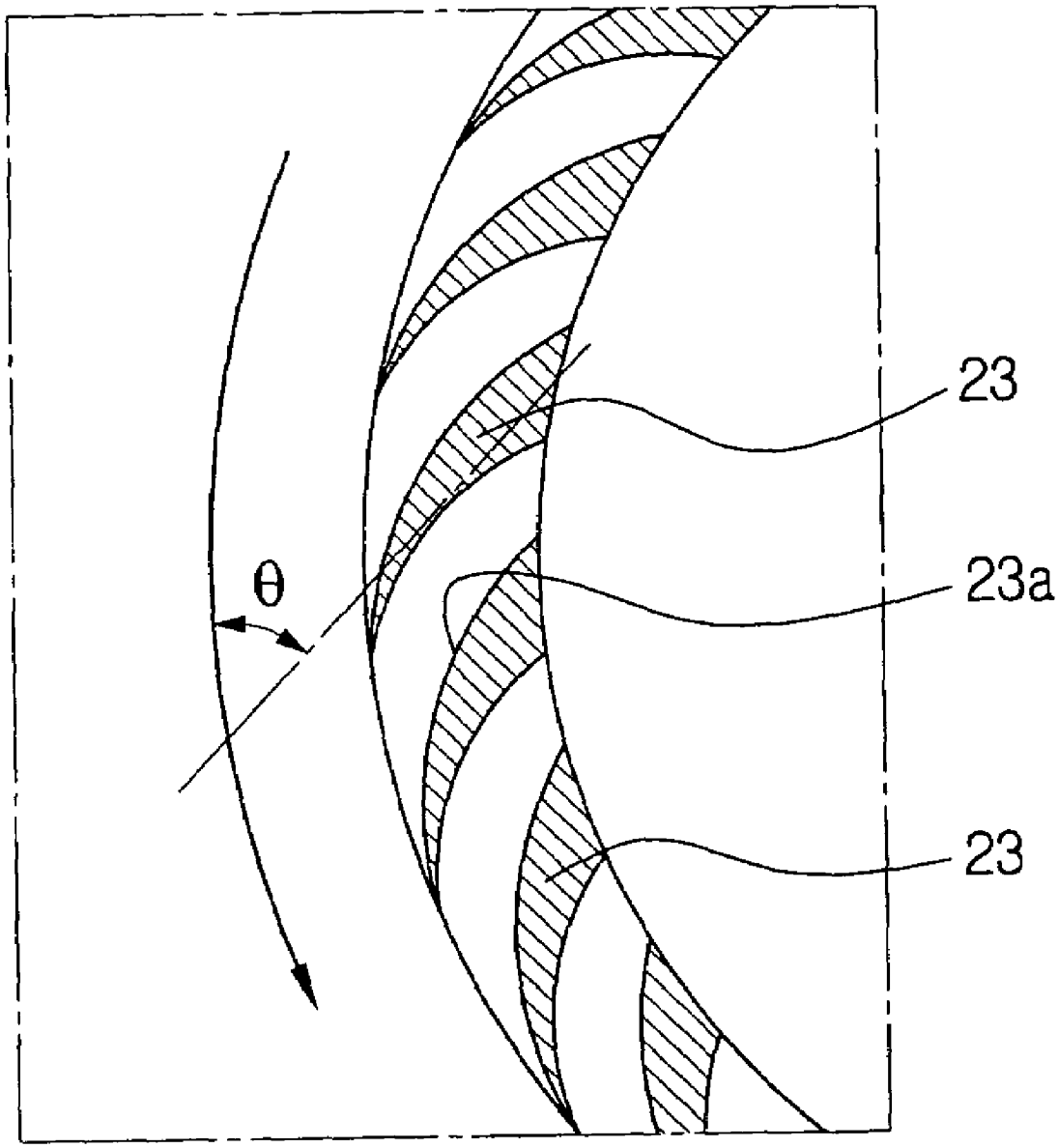
FIG. 2B (PRIOR ART)
FIG. 2B is a partial cross-sectioned view illustrating the operation of the louvers of the grill assembly of FIG. 2A.

Each louver 123 is arranged such that the centerline thereof is at an acute angle with respect to the streamline of the spinning air so as to define an air passage on the outer circumference of the grill body in fluid contact with the first air outlet 113 (FIG. 2B). Due to the presence of the louvers 123, the velocity of spinning air current changes and thus, backflow of the dust is prevented. As the acute angle is smaller, or, the gap between the louvers 123 is narrower (in other words, as the width of the air passage is narrower), prevention of the dust backflow is more ensured. However, as much as the acute angle or the gap narrows, the air passing the air passage experiences greater resistance.

As noise increases and suction force deteriorates, the performance of the vacuum cleaner degrades. Accordingly, it is preferable to arrange the louvers 123 at a predetermined acute angle and predetermined intervals such that, with shadows of the louvers 123 being cast on an imaginary coaxial cylinder, the shadow of one louver 123 overlaps the shadow of adjacent louver 123 by the range of 10% to 50%.

The dust blocking member 125 is formed such that it covers the open lower end of the grill body 121, and serves to shift the advancing direction of the dust in the louver-headed air towards the spinning air inside of the cyclonic chamber 110. The dust blocking member 125 may be formed integrally with the grill body 121. Alternatively, the dust blocking member 125 may be secured to the grill body 121, and includes a first conical member 125*a* which increases in diameter toward the lower portion, and a second cylindrical member 125*b* extended directly downward from the first member 125*a* to a predetermined depth. In any case, the above structures ensure that the rising dust is effectively blocked and falls back towards the spinning air current, and accordingly, dust is prevented from rising towards the louvers 123, but is blocked and falls into the dust receptacle 140.

The filter assembly 130 is disposed at the outer side of the cyclonic chamber 110, and filters the dust which is not filtered at the grill assembly 120. The filter assembly 130 includes a filter member 131, a filter frame 133 in which the filter member 131 is seated, and a cover portion 135.

The filter frame 133 receives the filter member 131 therein, and has a second air outlet 133*a* formed at a position corresponding to the first air outlet 113 of the cyclonic chamber 110 so as to permit air to discharge from the cyclonic chamber 110. The filter frame 133 also has a third air outlet 133*b* formed at a side so that the air is discharged through the second conduit 163 which is fluidly connected with the air driving source (not shown). The filter frame 133 has a plurality of first support projections 133*b* formed inside of the filter frame 133 at a lower portion for causing the incoming air from the second air outlet 133*a* to be evenly distributed and passed. The filter frame 133 has a screw hole 133*c* for a screw-fastening with the upper side of the cyclonic chamber 110. It is preferable that the screw holes of the grill body 121, the cyclonic chamber 110 and the filter frame 133 are formed to correspond to each other, because integrally screw-fastening the grill body 121 the cyclonic chamber 110 and the filter frame 133 through the corresponding screw holes reduces the number of parts.

Meanwhile, according to the first preferred embodiment of the present invention, the filter frame 133 may be integrally connected to the upper portion of the cyclonic chamber 110.

The cover portion 135 is removably connected to the filter frame 133 by the rotatable connecting means 150, and has a plurality of second support projections 135*a* formed inside at the upper portion so that the air past through the filter member 131 can pass through the third air outlet 133*b*. The first and second support projections 133*b*, 135*a* securely support the filter member 131 so that the filter member 131 is not moved by the air current. Free ends of the first and second support projections 133*b*, 135*a* are rounded so as not to damage the filter member 131 which is disposed therebetween.

The rotatable connecting means 150 includes connecting groove portions 152 abutting on the open upper side of the filter frame 133, and connecting projection 151 protruding from the cover portion 135 in a radial direction.

More specifically, the connecting groove portions 152 are formed on the upper side of the filter frame 133 opposite each other. One side of each connecting groove portion 152 is open with respect to the rotational direction of the cover portion 135, while the opposite side is closed. Accordingly, as the cover portion 135 is rotated, the connecting projections 151 are inserted in the open sides of the connecting groove portions 152, and then stopped by the closed sides of the connecting groove portions 152. For the user to easily rotate the cover portion 135, it is preferable to use a grip 135*b* on the outer surface of the upper side of the cover portion 135. Since the cover portion 135 is secured to the filter frame 133 by the rotatable connecting means 150, in a state that the filter member 131 is supported on the first and second support projections 133*b*, 135*a*, a need for an additional filter member securing device is eliminated.

The operation of the dust collecting apparatus 100 for the cyclone type vacuum cleaner is described below.

By the air driving source (not shown) of the cyclone type vacuum cleaner, dust laden air is drawn in through the suction brush (not shown). The dust-laden air is then drawn to the cyclonic chamber 110 through the air inlet 111 which is connected to the first conduit 161 that is in fluid contact with the suction brush. Because the air enters the air inlet 11 tangentially with respect to the cyclonic chamber 110, the air spins in the cyclonic chamber 110.

By the centrifugal force of the spinning air, dust is pushed out from the air current and collected in the dust receptacle 140. If there is any remaining dust that is not separated in the above process, the dust is re-separated as the air passes through the louvers 123 of the grill assembly 120. That is, while the air passes through the grill assembly 120, the dust is blocked by the dust blocking member 125 and thus, prevented from rising, and instead falls back to the spinning air where the dust is thrown out and collected in the dust receptacle 140.

Meanwhile, any remaining dust that is not separated by the louvers 123 of the grill assembly 120, is passed through the first air outlet 113 of the cyclonic chamber 110 and re-filtered at the filter assembly 130 that is disposed outside of the cyclonic chamber 110. The clean air is passed through the third air outlet 133*b* and the second conduit 163, and discharged outside via the air driving source. By use of the above structures, dust from the air can be effectively separated.

Figure 5:
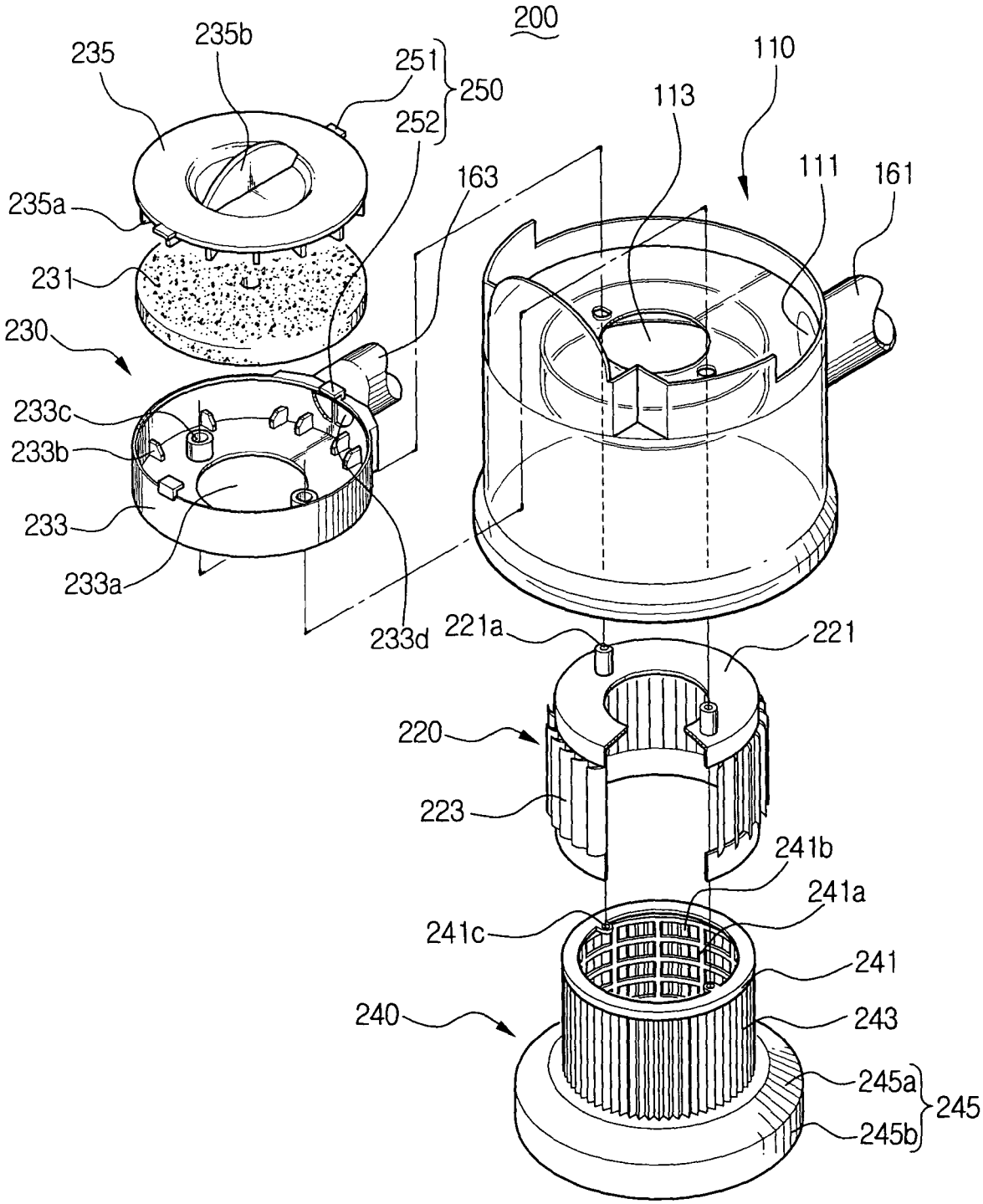
FIG. 5 is an exploded perspective view schematically illustrating a dust collecting apparatus for a cyclone type vacuum cleaner according to a second preferred embodiment of the present invention.
Figure 6:
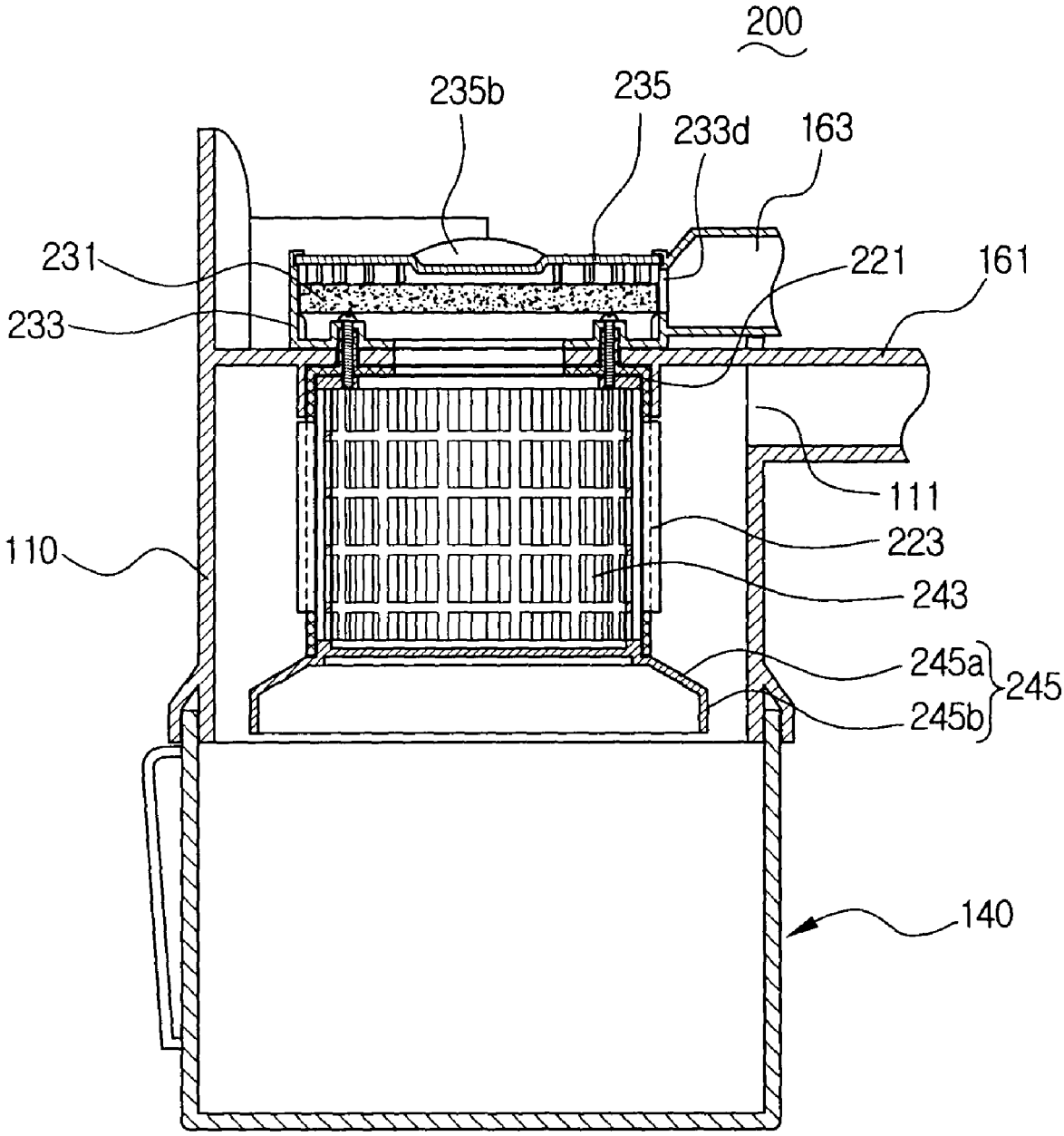
FIG. 6 is a schematic sectional view illustrating the dust collecting apparatus of FIG. 5.

Meanwhile, a dust collecting apparatus 200 for a cyclone type vacuum cleaner according to a second preferred embodiment of the present invention includes, as shown in FIGS. 5 and 6, a cyclonic chamber 110, a dust receptacle 140, a grill assembly 220, a main filter assembly 240 and a supplementary filter assembly 230.

The cyclonic chamber 110 and the dust receptacle 140 are constructed and operated in the same manner as described above in the first preferred embodiment, and accordingly, further description thereof will be omitted.

The main filter assembly 240 is removably connected inside the grill assembly 220, and filters and thus reduces the dust passing through the grill assembly 220 from flowing out of the cyclonic chamber 110. The main filter assembly 240 includes a main filter member 243, a main filter support portion 241, and a dust blocking portion 245.

The main filter member 243 can be preferably formed of a washable material for convenient cleaning, and have folds formed thereon for the sake of increasing contact area relative to the incoming air from the grill assembly 220.

The folds are formed in the lengthwise direction of the main filter member 243, and the main filter member 243 is preferably formed of polyester.

The main filter support portion 241 has a plurality of frames 241*a* for supporting the main filter member 243 from within. There are a plurality of air holes 241*b* formed among the plurality of frames 241*a*, for permitting the air to pass through the main filter member 243 and discharge through the first air outlet 113. There is a screw hole 241*c* formed on the upper side, for screw-fastening with the cyclonic chamber 110.

The dust blocking portion 245 is formed to cover the lower end of the main filter support portion 241. It is also possible that the dust blocking portion 245 is integrally formed with the main filter support portion 241. The dust blocking portion 245 includes a first conical member 245*a* gradually increasing in diameter towards the lower portion, and a second cylindrical member 245*b* extended directly downward from the first conical member 245*a* to a predetermined depth. The first and second members 245*a*, 245*b* may be integrally formed with each other.

Meanwhile, although it was depicted in the second embodiment that the dust blocking portion 245 is formed at the main filter support portion 241, the dust blocking portion 245 may also be formed at the grill body 221 as in the first embodiment of the present invention.

The dust blocking portion 245 constructed as above shifts the direction of the dust in the louver-headed air back to the spinning air inside the cyclonic chamber 110, and the dust is prevented from rising towards the louver 223, and instead falls into the dust receptacle 140.

The grill assembly 220 includes a grill body 221 and a plurality of louvers 223 formed on the outer circumference of the grill body 221. The upper side of the grill body 221 is removably connected with the upper portion of the cyclonic chamber 110, while the lower side of the grill body 221 is sealingly supported on the dust blocking portion 245 of the grill assembly 220.

The louvers 223 are formed on the outer circumference of the grill body 221 at an acute angle with respect to the streamline of the spinning air of the cyclonic chamber 110. The operation and effect of the louvers 223 are the same as described above and thus omitted here.

The grill body 221 has a screw hole 221*a* formed on the upper side and can be screw-fastened with the cyclonic chamber 110. According to this embodiment, the respective screw holes of the grill body 221, the filter support portion 231 and the supplementary filter frame 233 may be formed to correspond to each other so that the respective parts can be fastened with each other, integrally.

Alternatively, the grill body 221 may be integrally formed with the main filter assembly 240, requiring no additional fastening such as screw-fastening.

The supplementary filter assembly 230 includes a supplementary filter member 231, a supplementary filter frame 233 receiving the supplementary filter member 231 therein, and a cover portion 235 removably connected with the supplementary filter frame 233. The structure and operation of the respective parts are same as described in the first embodiment, and thus, further description thereof will be omitted.

With the dust collecting apparatus 200 for a cyclone type vacuum cleaner according to the second preferred embodiment of the present invention, the dust separation is performed more effectively because the remaining dust, which has not separated by the louvers 223 and the dust blocking portion 245, are filtered out as the air passes through the main filter member 243 of the main filter assembly 240.

Although a few preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A dust collecting apparatus for a vacuum cleaner, comprising:

a cyclonic chamber having an air inlet fluidly connected to a first conduit which is fluidly connected to a suction brush of a cleaner body, and a first air outlet, wherein the cyclone chamber is configured to impart a cyclonic spin on contaminant-laden air drawn through the air inlet;

a dust receptacle removably connected to the cyclonic chamber for receiving a contaminant which is thrown out from the spinning contaminant-laden air by centrifugal force;

a grill assembly disposed inside the cyclonic chamber and on an upstream side of the air outlet for preventing the thrown out contaminant from flowing backwards through the first air outlet; and a filter assembly formed at an outer side of the cyclonic chamber for filtering out the contaminant being discharged to the air outlet, the filter assembly comprising:

a filter member, a filter frame receiving the filter member therein, and having a second air outlet corresponding to the first air outlet of the cyclonic chamber, and a third air outlet fluidly connected with a second conduit which is fluidly connected to an air driving source, and a cover removably connected to the filter.

2. The dust collecting apparatus of claim 1, further comprising a plurality of first support projections formed along an inner surface of a lower portion of the filter frame, for causing the incoming air from the second air outlet to be evenly distributed over the filter member.

3. The dust collecting apparatus of claim 1, further comprising a plurality of second support projections formed along an inner surface of an upper portion of the cover, for directing air from the filter member to flow through the third air outlet and also for supporting the filter member in cooperation with the first support projections.

4. The dust collecting apparatus of claim 3, wherein free ends of the first and the second support projections are rounded.

5. The dust collecting apparatus of claim 1, wherein the cover is connected to the filter frame by a rotatable connecting means.

6. The dust collecting apparatus of claim 5, wherein the rotatable connecting means comprises:

at least one connecting groove formed on the upper side of the filter frame, having one open side in the rotation direction of the cover; and at least one connecting projection formed on the cover in a radial direction for inserting in the open side of the connecting groove.

7. The dust collecting apparatus of claim 6, wherein the cover comprises a grip, for rotating the cover and connecting the cover to the filter frame.

8. The dust collecting apparatus of claim 1, wherein the filter frame is removably fastened to the upper side of the cyclonic chamber.

9. The dust collecting apparatus of claim 1, wherein the filter frame is integrally formed with the upper side of the cyclonic chamber.

10. The dust collecting apparatus of claim 1, wherein the grill assembly comprises:

a grill body;

a plurality of louvers formed on the outer circumference of the grill body at an acute angle with respect to the streamline of the spinning air; and a dust blocking member formed at an upstream end of the grill body, for deflecting the contaminant toward the spinning air.

11. The dust collecting apparatus of claim 10, wherein the upper side of the grill body includes a screw hole for screw-fastening the grill body to the cyclonic chamber.

12. The dust collecting apparatus of claim 11, wherein the lower side of the filter frame includes a screw hole corresponding to the screw hole on the upper side of the grill body, whereby the grill body, the cyclonic chamber and the filter frame are screw-fastened to each other, integrally.

13. The dust collecting apparatus of claim 10, wherein the dust blocking member is integrally formed with the grill body.

14. The dust collecting apparatus of claim 10, wherein the dust blocking member comprises:

a first conical member secured to the grill body and increasing in diameter towards the lower portion of the first conical member; and a second cylindrical member connected to the first conical member and extending downwardly from the first conical member to a predetermined depth.

15. The dust collecting apparatus of claim 14, wherein the first conical member and the second cylindrical member are integrally formed with each other.

16. A dust collecting apparatus for a cyclone type vacuum cleaner, comprising:

a cyclonic chamber having an air inlet fluidly connected to a first conduit which is fluidly connected to a suction brush of a cleaner body, and a first air outlet, wherein the cyclone chamber is configured to imparts a cyclonic spin on a contaminant-laden air drawn thereto through the air inlet;

a dust receptacle removably connected to the cyclonic chamber for receiving a contaminant which is thrown out from the spinning contaminant-laden air by centrifugal force;

a grill assembly disposed inside the cyclonic chamber and on an upstream side of the air outlet for preventing the thrown out contaminant from flowing backwards through the first air outlet;

a main filter assembly removably connected to the inside of the grill assembly, for filtering out the contaminant being discharged to the grill assembly; and a supplementary filter assembly formed at an outer side of the cyclonic chamber, for re-filtering out the contaminant flowing in through the first air outlet, wherein the main filter assembly comprises:

a main filter member for filtering the contaminant backflowing from the grill assembly;

a main filter support having a plurality of frames for supporting the main filter member; and a dust blocking member disposed at a lower end of the main filter support, for deflecting the contaminant in the grill assembly-headed air towards the spinning air, and wherein the supplementary filter assembly comprises:

a supplementary filter member;

a supplementary filter frame receiving the supplementary filter member therein, and having a second air outlet corresponding to the first air outlet of the cyclonic chamber, and a third air outlet fluidly connected to a second conduit which is fluidly connected to an air driving source; and a cover removably connected to the upper side of the supplementary filter frame.

17. A dust collecting apparatus for a cyclone type vacuum cleaner, comprising:

a cyclonic chamber having an air inlet fluidly connected to a first conduit which is fluidly connected to a suction brush of a cleaner body, and a first air outlet, wherein the cyclone chamber is configured to impart a cyclonic spin on a contaminant-laden air drawn thereto through the air inlet;

a dust receptacle removably connected to the cyclonic chamber for receiving a contaminant which is thrown out from the spinning contaminant-laden air by centrifugal force;

a grill assembly disposed inside the cyclonic chamber and on an upstream side of the air outlet for preventing the thrown out contaminant from flowing backwards through the first air outlet;

a main filter assembly removably connected to the inside of the grill assembly, for filtering out the contaminant being discharged to the grill assembly; and a supplementary filter assembly formed at an outer side of the cyclonic chamber, for re-filtering out the contaminant flowing in through the first air outlet, and wherein the main filter assembly comprises:

a main filter member for filtering the contaminant backflowing from the grill assembly;

a main filter support having a plurality of frames for supporting the main filter member; and a dust blocking member disposed at a lower end of the main filter support, for deflecting the contaminant in the grill assembly-headed air towards the spinning air, and wherein the grill assembly comprises;

a grill body, having an upper side removably connected to the upper side of the cyclonic chamber and a lower side sealingly supported on the dust blocking member; and a plurality of louvers formed on the outer circumference of the grill body at an acute angle with respect to the streamline of the spinning air, and wherein the supplementary filter assembly comprises:

a supplementary filter member;

a supplementary filter frame receiving the supplementary filter member therein, and having a second air outlet corresponding to the first air outlet of the cyclonic chamber, and a third air outlet fluidly connected to a second conduit which is fluidly connected to an air driving source; and a cover removably connected to the upper side of the supplementary filter frame.

18. A dust collecting apparatus for a cyclone type vacuum cleaner, comprising:

a cyclonic chamber having an air inlet fluidly connected to a first conduit which is fluidly connected to a suction brush of a cleaner body, and a first air outlet, wherein the cyclone chamber is configured to impart a cyclonic spin on a contaminant-laden air drawn thereto through the air inlet;

a dust receptacle removably connected to the cyclonic chamber for receiving a contaminant which is thrown out from the spinning contaminant-laden air by centrifugal force;

a grill assembly disposed inside the cyclonic chamber and on an upstream side of the air outlet for preventing the thrown out contaminant from flowing backwards through the first air outlet;

a main filter assembly removably connected to the inside of the grill assembly, for filtering out the contaminant being discharged to the grill assembly; and a supplementary filter assembly formed at an outer side of the cyclonic chamber, for re-filtering out the contaminant flowing in through the first air outlet, wherein the main filter assembly comprises:

a main filter member for filtering the contaminant backflowing from the grill assembly;

a main filter support having a plurality of frames for supporting the main filter member; and a dust blocking member disposed at a lower end of the main filter support, for deflecting the contaminant in the grill assembly-headed air towards the spinning air, and wherein the supplementary filter assembly comprises:

a supplementary filter member;

a supplementary filter frame receiving the supplementary filter member therein, and having a second air outlet corresponding to the first air outlet of the cyclonic chamber, and a third air outlet fluidly connected to a second conduit which is fluidly connected to an air driving source; and a cover removably connected to the upper side of the supplementary filter frame; and a plurality of first support projections formed along an inner surface of a lower portion of the filter frame, for causing the incoming air through the second air outlet to be evenly distributed over the supplementary filter member.

19. The dust collecting apparatus of claim 18, further comprising a plurality of second support projections formed along an inner surface of an upper portion of the cover, for directing air from the supplementary filter member to flow through the third air outlet and also for supporting the supplementary filter member in cooperation with the first support projections.

20. The dust collecting apparatus of claim 19, wherein the cover is connected to the supplementary filter frame by a rotatable connecting means.

21. The dust collecting apparatus of claim 20, wherein the rotatable connecting means comprises:

at least one connecting groove formed on the upper side of the filter frame, having one open side in the rotation direction of the cover; and at least one connecting projection formed on the cover in a radial direction for inserting in the open side of the connecting groove.

22. The dust collecting apparatus of claim 21, wherein the cover comprises a grip for rotating the cover and connecting the cover to the filter frame.

23. The dust collecting apparatus of claim 19, wherein the supplementary filter frame is removably fastened to the upper side of the cyclonic chamber.

24. The dust collecting apparatus of claim 19, wherein the supplementary filter frame is integrally formed with the upper side of the cyclonic chamber.

25. The dust collecting apparatus of claim 23, wherein, the upper side of the grill body includes a screw hole for a screw-fastening with the cyclonic chamber, the upper side of the main filter support portion includes a screw hole corresponding to the screw hole on the grill body, the lower side of the supplementary filter frame includes a screw hole corresponding to the screw hole on the upper side of the grill body, and the grill body, the main filter support portion, the cyclonic chamber and the supplementary filter frame are screw-fastened to each other, integrally.

* * * * *